US005403670A

United States Patent [19]

Ohsue et al.

[11] Patent Number: 5,403,670

[45] Date of Patent: Apr. 4, 1995

[54] COMPOUND SLEEVE ROLL AND METHOD FOR PRODUCING SAME COMPRISING CHAMFERED AXIAL ENDS

[75] Inventors: Takuya Ohsue; Akira Noda; Hiroshi Fukuzawa; Itsuo Korenaga, all of Kitakyusyu, Japan

[73] Assignee: Hitachi Metals, Ltd., Tokyo, Japan

[21] Appl. No.: 170,867

[22] Filed: Dec. 21, 1993

[30] Foreign Application Priority Data

Dec. 21, 1992 [JP] Japan ..... 4-340234

[51] Int. Cl.[6] ..... B22F 7/04

[52] U.S. Cl. ..... 428/564; 428/553; 492/28; 419/8; 419/11; 419/14; 419/28; 419/49

[58] Field of Search ..... 29/895.33; 419/8, 11, 419/14, 28, 49; 428/553, 564; 492/28

[56] References Cited

U.S. PATENT DOCUMENTS 3,718,956 3/1973 Sekimoto et al. ..... 29/132
5,053,284 10/1991 Noda et al. ..... 428/552
5,106,576 4/1992 Noda et al. ..... 419/8

FOREIGN PATENT DOCUMENTS 510598 10/1992 European Pat. Off. .
2-080109 3/1990 Japan .

*Primary Examiner*—Donald P. Walsh
*Assistant Examiner*—Anthony R. Chi
*Attorney, Agent, or Firm*—Sughrue, Mion, Zinn, Macpeak & Seas

[57] ABSTRACT

The crack-resistant compound sleeve roll having a shell portion made of a sintered alloy and a core portion made of steel is produced by (a) charging an alloy powder consisting essentially, by weight, of 1.0–3.5% of C, 2% or less of Si, 2% or less of Mn, 10% or less of Cr, 3.0–15.0% of W, 2.0–10.0% of Mo and 1.0–15.0% of V, the balance being substantially Fe and inevitable impurities, into a metal capsule disposed around a roll core; (b) after evacuation and sealing, subjecting the alloy powder to a HIP (hot isostatic pressing) treatment at 1100°–1300° C. to form a shell portion; (c) after removing the metal capsule, subjecting the sintered shell portion to a heat treatment having hardening at 1140°–1220° C. and annealing at 540°–620° C.; and (d) chamfering edge portions of the roll on both axial ends thereof such that a boundary of the shell portion and the core portion exists in a chamfered surface.

7 Claims, 5 Drawing Sheets

COMPOUND SLEEVE ROLL AND METHOD FOR PRODUCING SAME COMPRISING CHAMFERED AXIAL ENDS

BACKGROUND OF THE INVENTION

The present invention relates to a compound sleeve roll suitable for hot and cold rolling and a method for producing it, and more particularly to a crack-resistant compound sleeve roll having a chamfered portion from an outer surface of a shell portion to an end surface of a core portion, and a method for producing it.

The rolls are required to have roll surfaces suffering from little wear, little surface roughening, little sticking with materials being rolled, less cracks and fractures, etc. For this purpose, cast compound rolls having hard outer surfaces and forged steel rolls having roll body portions hardened by a heat treatment, etc. are conventionally used depending on applications.

As further improved wear resistance is required for rolls, compound rolls having shell portions produced from sintered alloys have recently been provided. For instance, Japanese Patent Laid-Open No. 62-7802 discloses a compound roll constituted by a shell portion and a roll core, the shell portion being made from powder of high-speed steels such as SKH52, SKH 10, SKH57, SKD11, etc., high-Mo cast iron, high-Cr cast iron, high-alloy grain cast iron, Ni-Cr base alloy, etc., and diffusion-bonded to the roll core by a HIP treatment.

These rolls produced by sintering alloy powders have been finding wide applications, in place of conventional cast iron rolls, from finish stands to intermediate stands for hot-rolling wires, rods, plates, etc. The rolls produced by sintering alloy powders are superior to the cast iron rolls with respect to wear resistance and resistance to surface roughening, but they are still insufficient in crack resistance.

The above conventional east iron rolls may be reused by grinding to remove heat cracks generated on a shell surface during rolling operations. However, the sintered alloy rolls would be broken if they continue to be used with cracks remaining in the shell portions, because the cracks easily propagate through the rolls.

Japanese Patent Laid-Open No. 2-80109 discloses a compound roll produced by sintering high-alloy powders by a HIP method, in which a transformation stress generated at the time of a heat treatment is relaxed by a special design of the roll. Specifically, this compound roll has a core portion 21 around which a roll body portion 22 is formed, the roll body portion 22 having on both sides annular projections 24, and a hardened layer 23 made of a high-alloy metal showing excellent rolling characteristics being integrally bonded between the annular projections 24. Each annular projection 24 has an annular groove 25 near the axial end 27 of the hardened layer 23 to form a buffer wall portion 26 which acts to relax a transformation stress generated at the time of a heat treatment.

Although a sintered shell portion formed from high-alloy powder to meet the requirement of a high wear resistance is poorer in crack resistance than a core portion having excellent toughness, almost all stresses such as residual stress, rolling stress, heat stress, etc. are borne by the shell portion. Accordingly, cracking is highly likely to take place near the axial end of the roll. For this reason, rolling is usually conducted without permitting an article being rolled to pass through the rolls in a range of about 50 mm or less from each side end of the rolls. This inevitably leads to poor productivity and increased roll cost.

In the compound roll having such a roll shape as to relax a transformation stress on both sides which is disclosed in Japanese Patent Laid-Open No. 2-80109, a width of a hardened layer usable for rolling an article is restricted. Usually, edge portions of the roll on both sides are chamfered to a degree of about C10 (10 mm in axial direction and 10 mm in radial direction). However, these chamfers are made to prevent the roll edges from being broken by impinging other articles in the course of handling, but they do not contribute to relax the stress.

OBJECTS AND SUMMARY OF THE INVENTION

An object of the present invention is, accordingly, to provide a compound sleeve roll having a shell portion made of a sintered alloy and showing an excellent crack resistance.

Another object of the present invention is to provide a method for producing such a compound sleeve roll.

As a result of intense research in view of the above objects, the inventors have found that by positioning a boundary of the shell portion and the core portion in a chamfer at each axial end of the roll, a residual tensile stress in a radial direction can be minimized in a roll surface portion on both axial ends thereof.

The compound sleeve roll according to the present invention comprises a shell portion made of a sintered alloy and a core portion made of steel, the sintered alloy of the shell portion having a composition consisting essentially, by weight, of 1.0–3.5% of C, 2% or less of Si, 2% or less of Mn, 10% or less of Cr, 3.0–15.0% of W, 2.0–10.0% of Mo and 1.0–15.0% of V, the balance being substantially Fe and inevitable impurities, the edge portions of the roll on both axial ends being chamfered such that a boundary of the shell portion and the core portion exists in a chamfered surface.

The method for producing a compound sleeve roll according to the present invention comprises the steps of (a) charging an alloy powder consisting essentially, by weight, of 1.0–3.5% of C, 2% or less of Si, 2% or less of Mn, 10% or less of Cr, 3.0–15.0% of W, 2.0–10.0% of Mo and 1.0–15.0% of V, the balance being substantially Fe and inevitable impurities, into a metal capsule disposed around a roll core; (b) after evacuation and sealing, subjecting the alloy powder to a HIP (hot isostatic pressing) treatment at 1100°–1300° C. to form a shell portion; (c) after removing the metal capsule, subjecting the sintered shell portion to a heat treatment comprising hardening at 1140°–1220° C. and annealing at 540°–620° C.; and (d) chamfering edge portions of the roll on both axial ends thereof such that a boundary of the shell portion and the core portion exists in a chamfered surface.

DETAILED DESCRIPTION OF THE PREFERRED EMBODIMENTS

[1] Sintered alloy of shell portion

Figure 1:
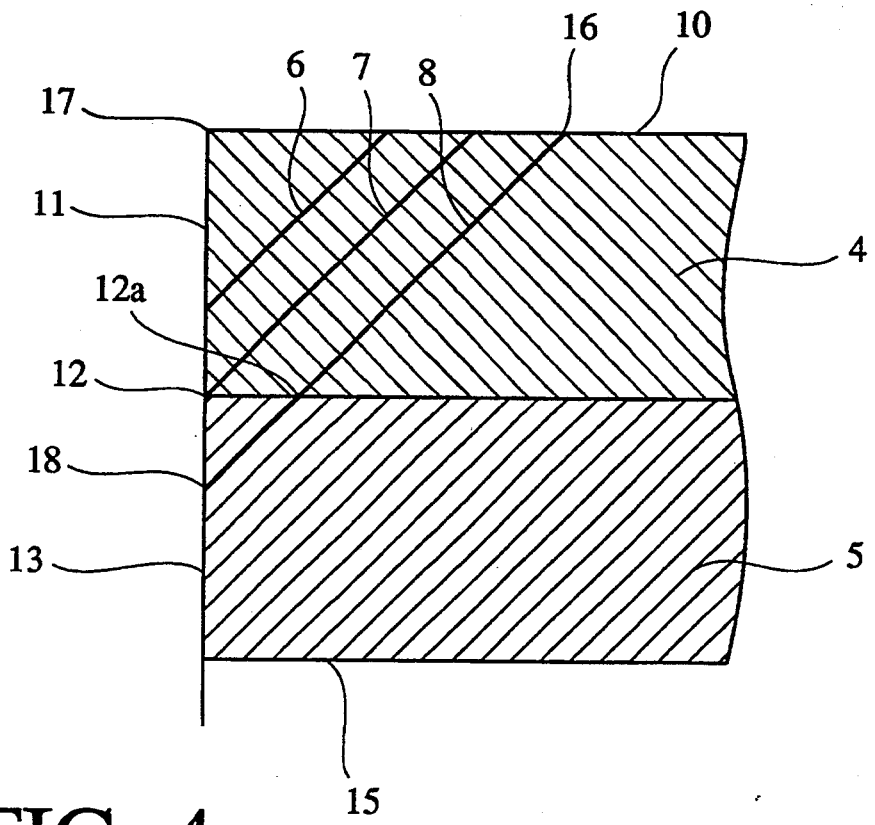
FIG. 1 is a partial cross-sectional view showing various chamfered surfaces at an axial end of the compound sleeve roll.

The alloy powder used for producing a shell portion of the wear-resistant compound sleeve roll of the present invention has a composition consisting essentially, by weight, of 1.0–3.5% of C, 2% or less of Si, 2% or less of Mn, 10% or less of Cr, 3.0–15.0% of W, 2.0–10.0% of Mo and 1.0–15.0% of V, the balance being substantially Fe and inevitable impurities. This alloy powder may optionally contain 3.0–15.0 weight % of Co.

(1) C: 1.0–3.5 weight %

In this alloy, C is combined with Cr, W, Mo and V to form hard carbides, contributing to the increase in wear resistance. However, when the carbon content is excessive, too much carbides are formed, making the alloy brittle. Further, C is dissolved in the matrix to provide the function of secondary hardening by tempering. However, if C is in an excess amount, the toughness of the matrix is decreased. For these reasons, the C content is 1.0–3.5 weight %. The preferred C content is 1.5–2.7 weight %.

(2) Si: 2 weight % or less

Since Si has the functions of deoxidization, hardening of the alloy matrix, increasing an oxidation resistance and a corrosion resistance, and improving the atomizability of the alloy, 2 weight % or less of Si is added. The preferred Si content is 0.2–1.0 weight %.

(3) Mn: 2 weight % or less

Mn is contained in an amount of 2 weight % or less, because it has the functions of deoxidization and increasing the hardenability of the alloy. The preferred Mn content is 0.2–1.0 weight %.

(4) Cr: 10 weight % or less

Cr not only contributes to the improvement of wear resistance by forming carbides with C but also enhances the hardenability of the alloy by dissolving into the matrix, and increasing the secondary hardening by tempering. However, when Cr is present in an excess amount, the matrix toughness is lowered. Accordingly, the Cr content is 10 weight % or less. The preferred Cr content is 3.0–5.0 weight %.

(5) W: 3.0–15.0 weight %, and Mo: 2.0–10.0 weight %

W and Mo not only increase wear resistance by combining with C to form $M_6C$-type carbides, but also increase the secondary hardening by tempering. However, when they are present in excess amounts, the toughness decreases, and the material becomes expensive. Accordingly, W is 3.0–15.0 weight %, and Mo is 2.0–10.0 weight %. The preferred amount of W is 3.0–10.0 weight %, and the preferred amount of Mo is 4.0–10.0 weight %.

(6) V: 1.0–15.0 weight %

V is combined with C like W and Mo. It forms MC-type carbides which have a hardness Hv of 2500–3000, extremely larger than the hardness Hv of 1500–1800 of the $M_6C$-type carbides. Accordingly, V is an element contributing to the improvement of wear resistance, thereby increasing a service life of the roll. However, if it is added excessively, the toughness and machinability of the roll would become poor. On the other hand, if the V content is too small, a sufficient effect cannot be achieved. Accordingly, the V content is 1.0–15.0 weight %, preferably 4.0–10.0 weight %.

(7) Co: 3.0–15.0 weight %

Co is an arbitrary element effective for providing an alloy with heat resistance. However, when it is in an excess amount, it lowers the toughness of the alloy. Accordingly, Co may be added in an amount of 3.0–15.0 weight %, more preferably 5.0–10.0 weight %.

In the production of the alloy powder, an alloy having the above composition is melted and formed into powder by a gas atomization method, etc. The alloy powder obtained by such a method desirably may have an average particle size of 30–300 μm.

[2] Core portion

The core portion of the compound sleeve roll of the present invention may be produced by any steel such as east steel, forged steel, rolled steel, etc. as long as it has such a sufficient strength as to withstand a high load of rolling.

[3] Production of compound sleeve roll

Figure 4:
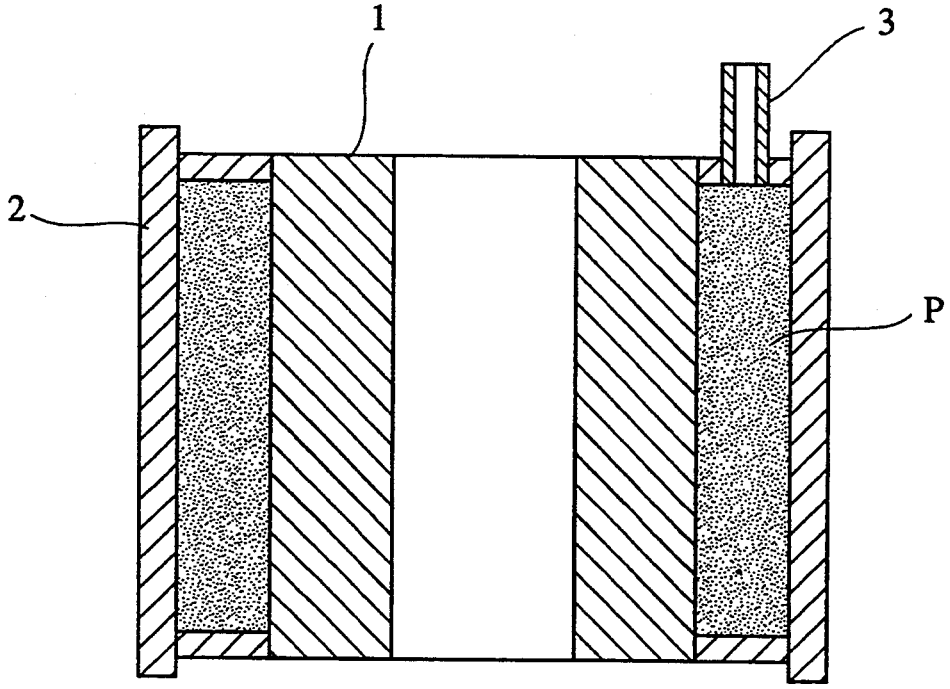
FIG. 4 is a cross-sectional view showing an apparatus for producing the compound sleeve roll of the present invention.

As shown in FIG. 4, the alloy powder "P" obtained by an atomization method, etc. is charged into a metal capsule 2 disposed around a roll core 1. The metal capsule 2 is evacuated through a vent 3 provided in an upper portion thereof and sealed to keep the inside of the metal capsule 2 in a vacuum state. It is then subjected to a HIP treatment. Incidentally, the metal capsule 2 may be made of steel or stainless steel plate having a thickness of about 3–10 mm.

The HIP treatment is usually conducted at a temperature of 1,100°–1,300° C., and a pressure of 1,000–1,500 atm in an inert gas atmosphere such as argon, etc. for 1–8 hours to form the compound sleeve roll in which the shell portion made of a sintered alloy having an excellent wear resistance is diffusion-bonded to the core portion having good mechanical strength and toughness.

Thereafter, the metal capsule 2 is removed by a lathe. It is then subjected to a heat treatment in a pattern shown, for instance, in FIG. 5. The heat treatment preferably comprises two steps of a hardening treatment at 1140°–1220° C. and an annealing at 540°–620° C. The desired compound sleeve roll is obtained after finish working by a lathe.

[4] Chamfering of compound sleeve roll

Although a compound sleeve roll consisting of a shell portion made of a sintered alloy and a core portion is likely to be cracked on an axial end thereof by a transformation stress, etc. generated at the time of a heat treatment or during rolling operations, such cracking can be prevented by chamfering both axial end portions of the compound sleeve roll before finish working and then conducting the finish working.

FIG. 1 is a partial cross-sectional view showing various types of chamfering at an axial end of the compound sleeve roll. Reference numerals 4 and 5 denote a shell portion and a core portion, respectively. Each type of chamfering is as follows:

(1) A chamfered surface 6 extends from an outer surface 10 of the shell portion 4 to an end surface 11 of the shell portion 4.

(2) A chamfered surface 7 extends from an outer surface 10 of the shell portion 4 to a boundary 12 of the shell portion 4 and the core portion 5.

(3) A chamfered surface 8 extends from an outer surface 10 of the shell portion 4 to an end surface 13 of the core portion 5. In this case, the boundary 12*a* of the shell portion 4 and the core portion 5 appears on the chamfered surface 8.

The chamfered surface 6 fails to prevent the cracking of the edge portions on both axial end portions of the compound sleeve roll. In this case, a large residual tensile stress ($\sigma_T$) exists in the shell portion near the boundary 12 of the shell portion 4 and the core portion 5. In the case of the chamfered surface 7, the residual tensile stress ($\sigma_T$) near the boundary 12 is almost zero, thereby preventing the cracking of the compound sleeve roll to some extent. In the case of the chamfered surface 8 including the boundary 12*a* of the shell portion 4 and the core portion 5, the cracking of the compound sleeve roll is well prevented. This appears to be due to the fact that the chamfered surface 8 functions to change the residual tensile stress ($\sigma_T$) existing in the shell portion 4 near the boundary 12 to a residual compression stress ($\sigma_T$) which effectively serves to increase a crack resistance. Accordingly, the chamfered surfaces 7 and 8 are within the scope of the present invention.

Incidentally, a point 16 on an outer surface 10 of the shell portion 4 from which the chamfered surface 8 extends is preferably 5–50 mm apart from an edge 17 of the shell portion 4 from the practical point of view. The chamfered surface 8 preferably includes the boundary 12*a* at a position of 2–30 mm from a point 18 at which it intersects the end surface 13 of the core portion 5 as shown in FIG. 1.

Although FIG. 1 shows all chamfered surfaces in a linear cross section, a curved chamfered surface or a chamfered surface consisting of two or more flat surfaces intersecting at a certain angle may also be used to obtain the same effects.

The present invention will be described in further detail by means of the following Examples, without any intention of restricting the scope of the present invention.

Comparative Example 1

Alloy powder P having a composition shown in Table 1 was charged into a cylindrical metal capsule 2 (outer diameter: 390 mm, height: 850 mm, thickness: 10 mm) disposed around a cylindrical roll core made of SCM 440 and having an outer diameter of 300 mm, an inner diameter of 240 mm and a length of 650 mm as shown in FIG. 4. The capsule 2 was evacuated through a vent 3 in an upper portion thereof while heating the overall capsule 2 at about 500° C., and the vent 3 was sealed to keep the inside of the capsule 2 at about $1\times10^{-3}$ Torr. Thereafter, this capsule 2 was placed in an argon gas atmosphere and subjected to a HIP treatment at a temperature of 1250° C. and pressure of 1000 atm for 2 hours.

TABLE 1

| Chemical Composition of Alloy Powder (wt. %) | | | | | | | | |
|---|---|---|---|---|---|---|---|---|
| C | Si | Mn | Cr | Mo | W | V | Co | Fe |
| 1.35 | 0.31 | 0.33 | 4.26 | 5.17 | 6.14 | 5.28 | 8.43 | Bal. |

Figure 5:
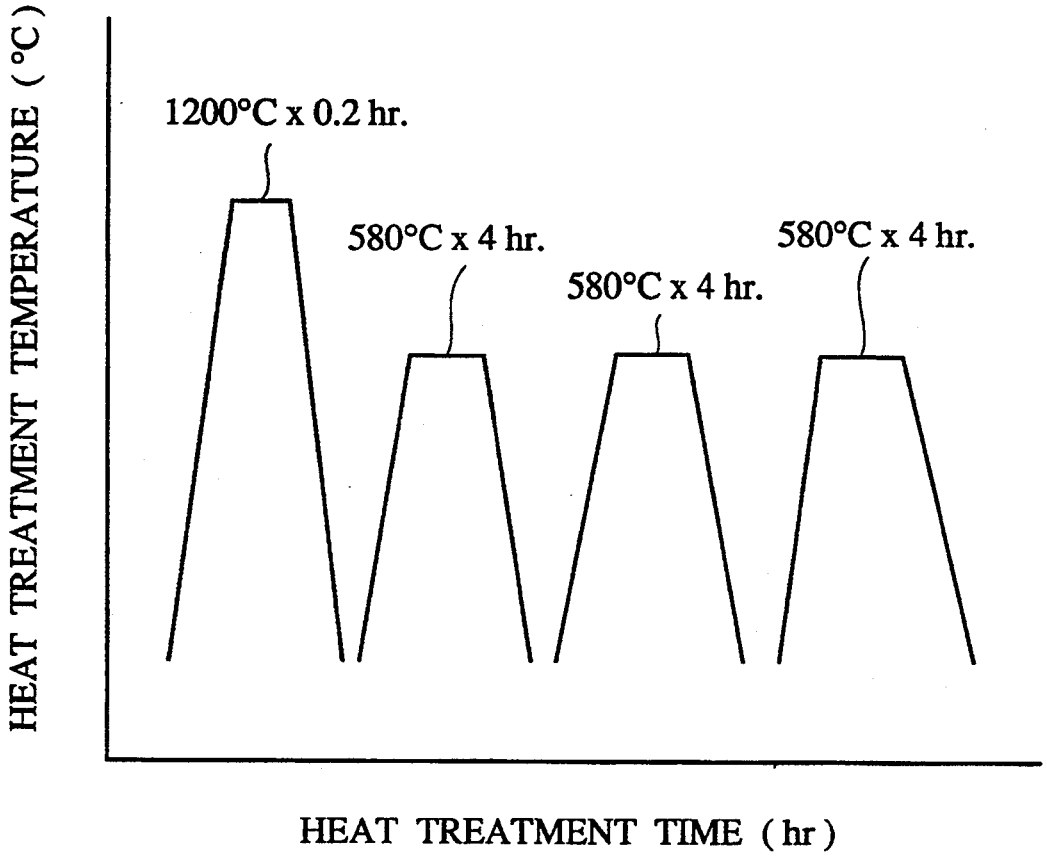
FIG. 5 is a schematic view exemplifying a heat treatment pattern for the compound sleeve roll of the present invention.
Figure 7:
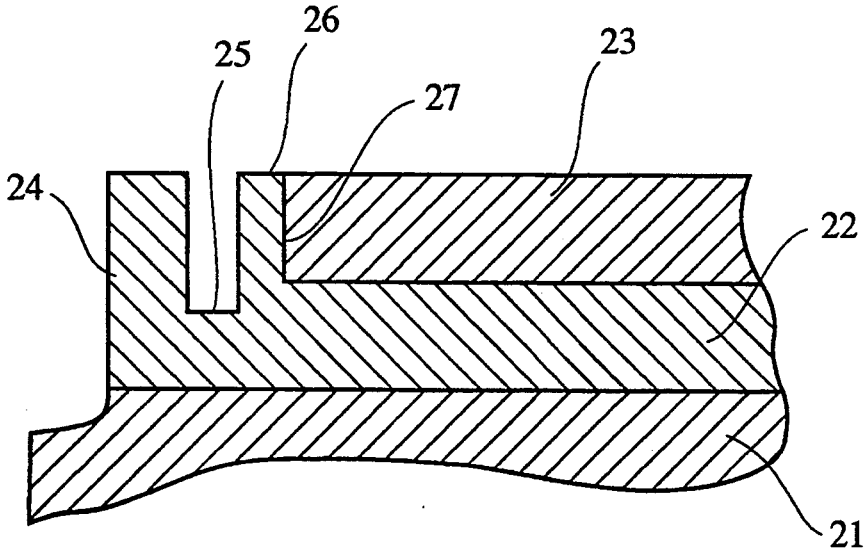
FIG. 7 is a partial cross-sectional view showing an axial end portion of a conventional compound roll having such a shape as to relax a transformation stress generated at the time of a heat treatment.

After the HIP treatment, the outside capsule 2 was removed by lathing, and the resulting compound sleeve roll was subject to a heat treatment in the pattern shown in FIG. 5. After finish working, the compound sleeve roll had a shell portion of an outer diameter of 360 mm and a thickness of 30 mm, and a core portion of an inner diameter of 240 mm and a length of 650 mm.

Without chamfering the edge portions of the compound sleeve roll on both axial end portions, this compound sleeve roll was used in an intermediate stand for rolling a wire. As a result, cracking took place on both axial end portions of the roll in areas from a boundary of the core portion and shell portion to an outer surface of the shell portion.

Figure 6:
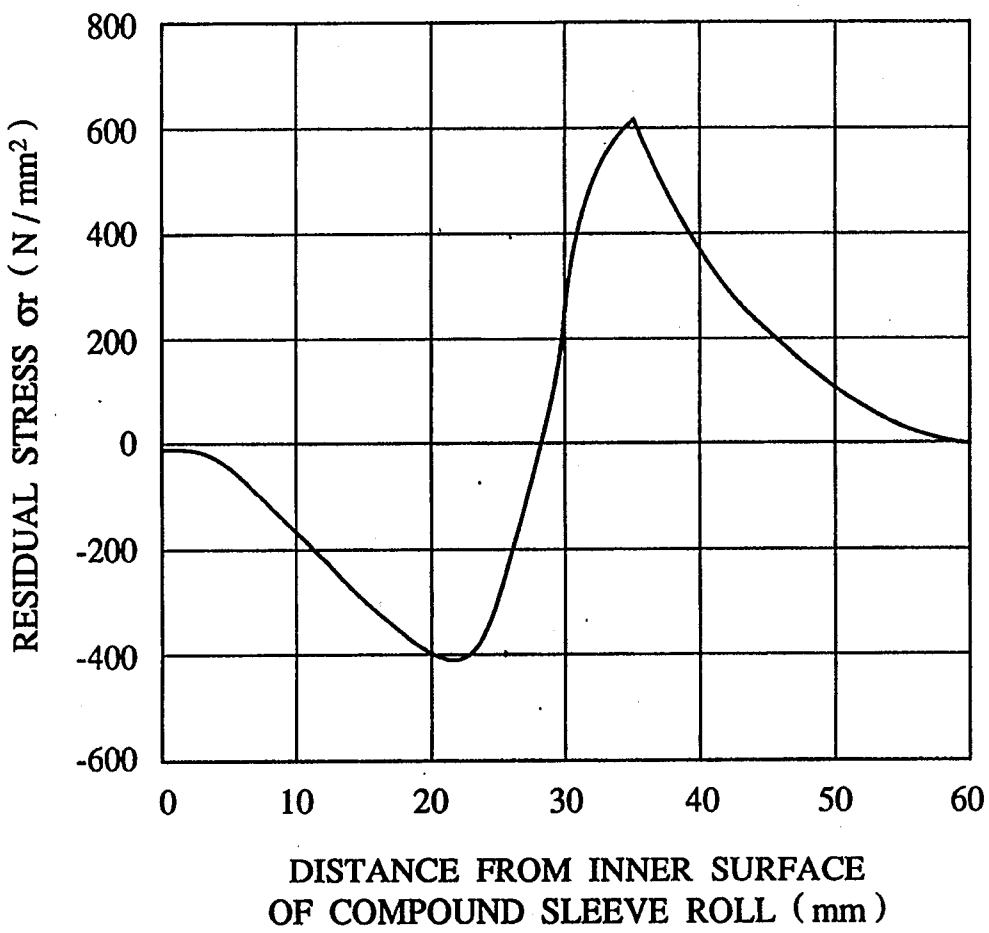
FIG. 6 is a graph showing the relation between a residual stress in an end portion and a distance from an inner surface in the compound sleeve roll of Comparative Example 1.

A radial residual stress ($\sigma_T$) on the axial end of the roll was calculated by a finite element method at a pitch of 10 mm from the inner surface of the roll. The calculated radial residual stress ($\sigma_T$) is shown in FIG. 6. It is clear from FIG. 6 that the maximum residual tensile stress ($\sigma_T$) exists in the shell portion near the boundary of the core portion and shell portion (located at a position of 30 mm from the inner surface of the compound sleeve roll). This position of the maximum residual tensile stress ($\sigma_T$) substantially coincides with a point from which cracks propagate as observed on a cracked surface of the roll. Also, the calculated values of the radial residual stress ($\sigma_T$) are in good agreement with the measured values.

Example 1

A compound sleeve roll consisting of a shell portion and a core portion was produced in the same manner as in Comparative Example 1. Before conducting a heat treatment, the compound sleeve roll was provided with three types of chamfering on both axial ends thereof in a manner as shown in FIG. 1. Thereafter, the compound sleeve roll was subjected to a heat treatment in the pattern shown in FIG. 5. Finally, finish working was conducted in the same manner as in Comparative Example 1.

As shown in FIG. 1, the three types of chamfering were as follows:

(1) A chamfered surface 6 extending from an outer surface 10 of the shell portion 4 to an end surface 11 of the shell portion 4.

(2) A chamfered surface 7 extending from an outer surface 10 of the shell portion 4 to a boundary 12 of the shell portion 4 and the core portion 5.

(3) A chamfered surface 8 extending from an outer surface 10 of the shell portion 4 to an end surface 13 of the core portion 5. In this case, the boundary 12*a* of the shell portion 4 and the core portion 5 appeared on the chamfered surface 8.

Figure 2:
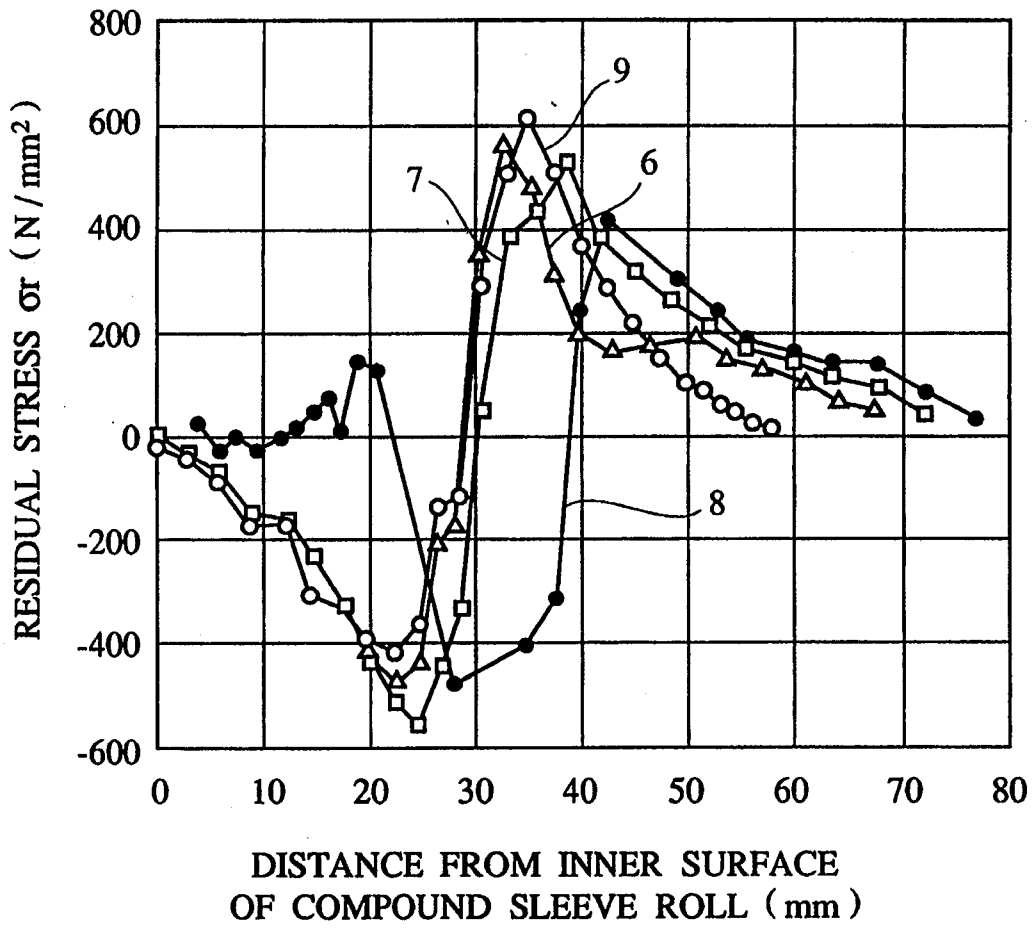
FIG. 2 is a graph showing the relation between a residual stress in an end portion of the roll and a distance from the inner surface of the compound sleeve roll provided with various chamfer shapes, which is not subjected to a heat treatment.

In each case, a radial residual stress ($\sigma_T$) on the axial end of the roll was calculated in the same manner as in Comparative Example 1. The results are shown in FIG. 2. Incidentally, in FIG. 2, 9 denotes a line representing a residual stress ($\sigma_T$) calculated on the compound sleeve roll without a chamfered surface. It is clear from FIG. 2 that the lowest residual stress ($\sigma_T$) can be achieved in the case of the chamfered surface 8 on which the boundary 12a of the shell portion 4 and the core portion 5 appears. The maximum residual tensile stress ($\sigma_T$) existing near the boundary 12 (at a position of 30 mm from the inner surface 15 of the compound sleeve roll) in the case of the chamfered surface 9 changed to the negative side, namely to a residual compression stress ($\sigma_T$) by forming the chamfered surface 8.

Example 2

Figure 3:
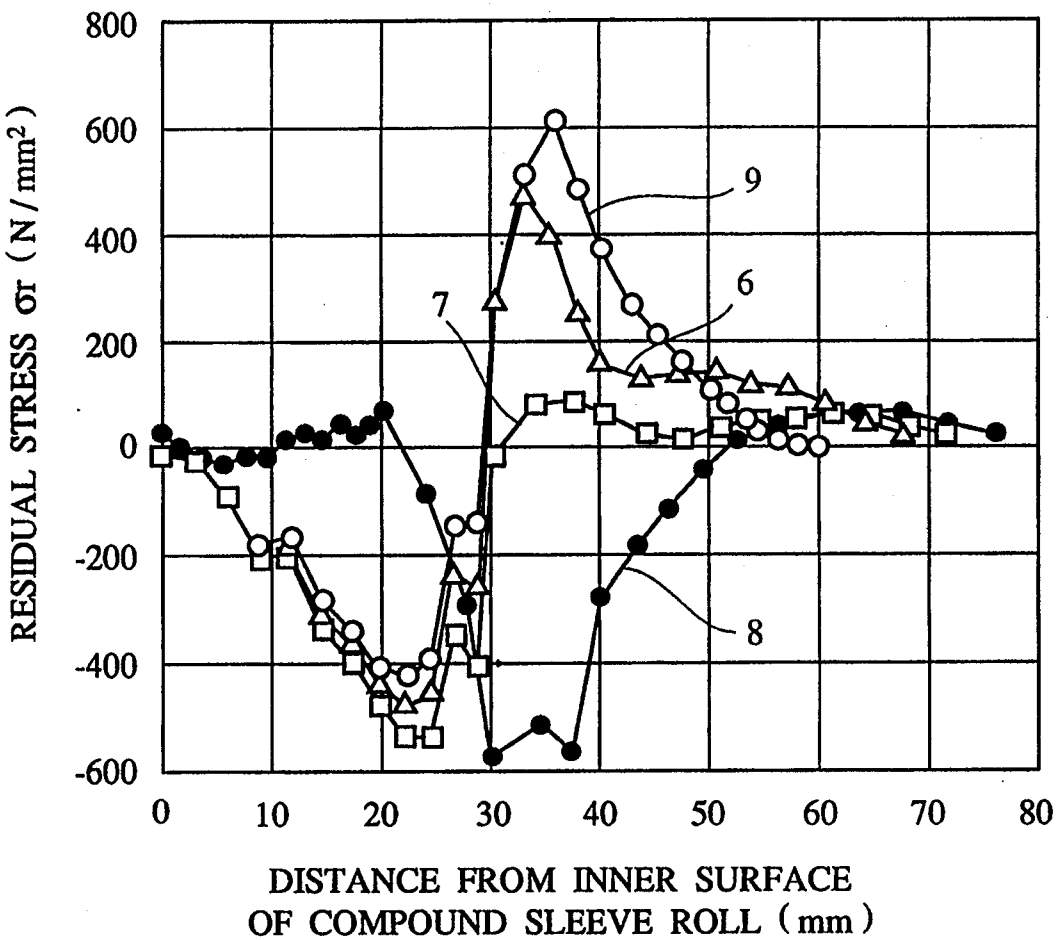
FIG. 3 is a graph showing the relation between a residual stress in an end portion of the roll and a distance from the inner surface of the compound sleeve roll provided with various chamfer shapes, which is subjected to a heat treatment.

A compound sleeve roll consisting of a shell portion and a core portion was produced in the same manner as in Comparative Example 1 except that the same three types of chamfering as in Example 1 were made on both axial ends of the compound sleeve roll after conducting the heat treatment in the pattern shown in FIG. 5. With respect to the three types of chamfering, a radial residual stress ($\sigma_T$) on the axial end of the roll was calculated in the same manner as in Example 1. The results are shown in FIG. 3. As in Example 1, in a case where there is no chamfered surface (line 9), the maximum residual tensile stress ($\sigma_T$) existed near the boundary 12 (at a position of 30 mm from the inner surface 15 of the compound sleeve roll). However, after the heat treatment, the residual tensile stress ($\sigma_T$) near the boundary 12 was almost zero even in the case of the chamfered surface 7. Further, in the case of the chamfered surface 8, the residual tensile stress ($\sigma_T$) actually changed to a residual compression stress ($\sigma_T$) near the boundary of the shell portion and the core portion.

The compound sleeve roll having the chamfered surface 8 was used in an intermediate stand for rolling a wire in the same manner as in Comparative Example 1. As a result, it was confirmed that no cracking took place on both axial ends of the compound sleeve roll.

Since the compound sleeve roll consisting of a shell portion made of a sintered alloy and a core portion made of steel according to the present invention has a chamfered surface on both axial end portions thereof in such a manner that the chamfered surface includes a boundary of the shell portion and the core portion, cracking can effectively be prevented at the time of a heat treatment or during rolling operations.

What is claimed is:

1. A compound sleeve roll comprising a shell portion made of a sintered alloy and a core portion made of steel, said edge portions of said roll on both axial ends being chamfered such that a boundary of said shell portion and said core portion exists in a chamfered surface.

2. The compound sleeve roll according to claim 1, wherein said sintered alloy of said shell portion having a composition consisting essentially, by weight, of 1.0–3.5% of C, 2% or less of Si, 2% or less of Mn, 10% or less of Cr, 3.0–15.0% of W, 2.0–10.0% of Mo and 1.0–15.0% of V, the balance being substantially Fe and inevitable impurities.

3. The compound sleeve roll according to claim 2, wherein said sintered alloy of said shell portion further contains 3.0–15.0% by weight of Co.

4. A method for producing a compound sleeve roll comprising the steps of (a) charging an alloy powder consisting essentially, by weight, of 1.0–3.5% of C, 2% or less of Si, 2% or less of Mn, 10% or less of Cr, 3.0–15.0% of W, 2.0–10.0% of Mo and 1.0–15.0% of V, the balance being substantially Fe and inevitable impurities, into a metal capsule disposed around a roll core; (b) after evacuation and sealing, subjecting said alloy powder to a HIP treatment at 1100°–1300° C. to form a shell portion; (c) after removing said metal capsule, subjecting the sintered shell portion to a heat treatment comprising hardening at 1140°–1220° C. and annealing at 540°–620° C.; and (d) chamfering edge portions of said roll on both axial ends thereof such that a boundary of said shell portion and said core portion exists in a chamfered surface.

5. The method according to claim 4, wherein said sintered alloy of said shell portion further contains 3.0–15.0% by weight of Co.

6. A method for producing a compound sleeve roll comprising the steps of (a) charging an alloy powder consisting essentially, by weight, of 1.0–3.5% of C, 2% or less of Si, 2% or less of Mn, 10% or less of Cr, 3.0–15.0% of W, 2.0–10.0% of Mo and 1.0–15.0% of V, the balance being substantially Fe and inevitable impurities, into a metal capsule disposed around a roll core; (b) after evacuation and sealing, subjecting said alloy powder to an HIP treatment at 1100°–1300° C. to form a shell portion; (c) after removing said metal capsule, chamfering edge portions of said roll on both axial ends thereof such that a boundary of said shell portion and said core portion exists in a chamfered surface; and (d) subjecting the sintered shell portion to a heat treatment comprising hardening at 1140°–1220° C. and annealing at 540°–620° C.

7. The method according to claim 6, wherein said sintered alloy of said shell portion further contains 3.0–15.0% by weight of Co.

* * * * *